US008502438B2

(12) United States Patent
Boehm et al.

(10) Patent No.: US 8,502,438 B2
(45) Date of Patent: Aug. 6, 2013

(54) SPARK PLUG ELECTRODE PRODUCED FROM AN IMPROVED ELECTRODE MATERIAL

(75) Inventors: Jochen Boehm, Marbach A.N. (DE); Jochen Rager, Bisingen (DE)

(73) Assignee: Robert Bosch GmbH, Stuttgart (DE)

( * ) Notice: Subject to any disclaimer, the term of this patent is extended or adjusted under 35 U.S.C. 154(b) by 622 days.

(21) Appl. No.: 12/733,029

(22) PCT Filed: Jul. 9, 2008

(86) PCT No.: PCT/EP2008/058927

§ 371 (c)(1), (2), (4) Date: Apr. 7, 2010

(87) PCT Pub. No.: WO2009/027139

PCT Pub. Date: Mar. 5, 2009

(65) Prior Publication Data

US 2010/0194258 A1 Aug. 5, 2010

(30) Foreign Application Priority Data

Aug. 29, 2007 (DE) ..... 10 2007 040 722

(51) Int. Cl.
*H01T 13/20* (2006.01)

(52) U.S. Cl.
USPC ..... 313/141; 313/118

(58) Field of Classification Search
USPC ..... 313/141, 118, 140, 143; 445/7
See application file for complete search history.

(56) References Cited

U.S. PATENT DOCUMENTS

| | | | | |
|---|---|---|---|---|
| 2003/0218411 | A1 | 11/2003 | Hrastnik | |
| 2007/0290591 | A1 * | 12/2007 | Lykowski et al. | 313/141 |

FOREIGN PATENT DOCUMENTS

| | | |
|---|---|---|
| DE | 39 16 378 | 2/1990 |
| DE | 102 24 891 | 12/2003 |
| JP | 2000-336446 | 12/2000 |
| JP | 2003-247039 | 9/2003 |
| JP | 2003-342655 | 12/2003 |

* cited by examiner

*Primary Examiner* — Joseph L Williams
(74) *Attorney, Agent, or Firm* — Kenyon & Kenyon LLP

(57) ABSTRACT

A spark plug electrode, which is produced from an electrode material containing nickel as base material, 0.5 to 3 atom % of silicon, and at least 6 atom % of aluminum.

18 Claims, No Drawings

SPARK PLUG ELECTRODE PRODUCED FROM AN IMPROVED ELECTRODE MATERIAL

BACKGROUND OF THE INVENTION

1. Field of the Invention

The present invention relates to a spark plug electrode, which is produced from an electrode material on a nickel basis.

2. Description of Related Art

Because of the continuous refinement of motor vehicle engines and their components in an effort to increase the performance and engine power, ever greater demands are placed on the materials of the engine components as well. Especially the components that play an important role in the ignition of the fuel mixture, the spark plugs, and especially the spark plug electrodes, are exposed to high stressing. In the ignition process, an ignition system controlled by the engine periodically generates a high voltage, which is discharged in a spark arc-over between the two electrodes of the spark plugs. The produced spark then ignites the compressed air-fuel mixture. In the process, the spark plug is subjected to permanent stressing by extremely high temperatures. To prevent the engine performance from decreasing in long-term operation as a result of leaking, poorly igniting or overheating spark plugs, the materials for producing spark plug electrodes for internal combustion engines are subject to ongoing further development.

In general, nickel alloys are used as base material for spark plug electrodes, because nickel not only has high melting temperatures, which are an absolute requirement for the temperature stability of the alloy, but also high resistance to corrosion. Although materials produced from pure noble metals or on the basis of noble metals, such as platinum or platinum alloys including iridium, exhibit increased wear resistance to spark-erosive attacks and thus provide a very high service life of the electrodes, spark plug electrode materials of platinum do not constitute a viable alternative to conventional nickel alloys for economic reasons in view of the enormous cost.

The resistance of nickel alloys manifests itself in low erosion losses, i.e., material removal from the electrode, induced by the reciprocal effect of the electric arc with the electrode surface, and in high oxidation and corrosion resistance. The corrosion resistance can be increased even further by metal additives such as aluminum, manganese, chromium and the like. Moreover, adding silicon to the nickel-base alloy increases the high-temperature oxidation resistance.

From the published German patent document DE 39 16 378A1, an alloy on nickel basis is known for use in spark plug electrodes for internal combustion engines, which is essentially made up of nickel, silicon, manganese and aluminum, the silicon weight component amounting to 0.1 to 1.5 weight %, the manganese component to 0.1 to 0.65 weight %, and the aluminum component to 3.1 to 5 weight %. Chromium up to 2 weight %, or Y or an element of the rare earths up to 0.5 weight % may be contained as additional components. According to the explanations in this printed publication, nickel alloys are obtained that exhibit good oxidation and corrosion resistance at increased temperatures as well as increased resistance to spark erosion as a result of their stability.

The higher stability does indeed increase the oxidation and corrosion resistance, but it also promotes chipping of material at the surface of the electrode, which is caused by the extreme thermal stressing in the spark arc-over between the center and the ground electrode as a result of the reduced elasticity. Furthermore, such a compact material is complex, expensive to produce and difficult to process.

It should be stated at the outset that, unless expressly denoted otherwise, all of the following atom % indications always relate to the total composition of the electrode material.

BRIEF SUMMARY OF THE INVENTION

Compared to known electrode materials based on nickel alloys, the spark plug electrode according to the present invention having the features of the main claim is characterized by an extremely high temperature resistance, minimized spark-erosive wear or electrode erosion, and it exhibits a unique oxidation and corrosion resistance. This provides a more cost-effective electrode material for spark plug electrodes, which enables a service life that previously could be achieved only with electrode materials made from noble metals and noble metal alloys. According to the present invention, this is achieved by producing the spark plug electrode from an electrode material that contains nickel as base material and which additionally contains 0.5 to 3 atom % of silicon and at least 6 atom % of aluminum.

The dependent claims show preferred further developments and improvements of the present invention.

It is especially advantageous that the spark plug electrode according to the present invention contains an alloy that is optimized with regard to the chemical and physical properties.

The combination of nickel, silicon and aluminum in the specified quantities makes it possible to produce the alloy both in a simple manner and without losses, and it also leads to a satisfactory use profile in the long term because of its homogeneity.

To be mentioned, in particular, is the extreme temperature stability of the spark plug electrode according to the present invention, which manifests itself in outstanding resistance with respect to spark erosion and oxidation as well as corrosion resistance even when the spark plug is operated over the long term.

In addition, it should be stressed that the spark plug electrode according to the present invention exhibits improved thermal conductivity in comparison with the known materials.

It is advantageous, in particular, that the selective combination of the electrode material according to the present invention with additional reactive elements makes it possible to reduce the spark-erosive wear even further and to increase the oxidation and corrosion resistance.

The sum of the advantages of the spark plug electrode according to the present invention results in especially long exchange intervals of the spark plug and in increased acceptance on the market because of the long service life that is able to be achieved in this manner.

DETAILED DESCRIPTION OF THE INVENTION

The present invention relates to a spark plug electrode, which is produced from an electrode material that contains nickel, 0.5 to 3 atom % of silicon, and at least 6 atom % of aluminum. As already mentioned earlier, such an electrode material has advantages with regard to the oxidation and corrosion resistance, and it also exhibits excellent resistance to spark-erosive wear. When a spark is ignited between the center and the ground electrode of a spark plug, the high temperatures in the spark arc-over cause wear of the material at the two surfaces of the electrodes due to oxidation processes or by melting or chipping of material regions close to the surface. This is called spark-erosive wear. The related art counteracts this chipping or blasting off of electrode material by adding aluminum and silicon to the nickel base alloy. The quantity of silicon maximally to be incorporated has been found to lie in a range from approximately 1.5 to 3 weight %, and the maximum component of aluminum still permitting sufficient processing of the alloy material, to be 5 weight %.

To their surprise, the inventors have now discovered that especially components of more than 6 atom % of aluminum in a nickel alloy cause a considerably reduction in the spark-erosive wear. Without being bound to the theory, it is assumed that the highly doped aluminum component of the nickel base alloy leads to the formation of a virtually uninterrupted if thin aluminum oxide layer at the surface of the electrode material. This aluminum oxide layer is resistant to chipping and melting induced by the high temperatures in the spark discharge between the electrodes. This does not mean that the aluminum oxide layer separates out from the nickel alloy material and forms a separate layer. Instead, the situation is such that because of the composition of the electrode material according to the present invention, the processability is so satisfactory that a homogenous distribution of the metals and metal oxides prevails. Because of the high overall aluminum content its percentage is increased at the surface of the electrode material as well. The partial oxidation of the aluminum atoms at the electrode surface produces uniformly distributed aluminum-oxide regions that have excellent resistance to spark-erosive wear, which resistance is considerably higher than in the case of nickel oxide.

Because of the high doping of the nickel-base alloy with aluminum, if chipping of aluminum oxide particles takes place, additional aluminum from the interior of the alloy is able to be resupplied to the surface of the electrode material, which then forms a durable oxide layer again. The nickel-base material is therefore protected and subject to considerably reduced erosion.

Contrary to prevailing opinion regarding the poor processability of highly aluminum-doped nickel alloy material, it came as a surprise to discover that in particular the combination of high aluminum components and relatively high silicon components leads to a nickel-base alloy that facilitates simple processing into a homogenous alloy material. The aluminum component is not restricted in particular. Quite common quantities lie within a range of approximately 30 to 40 atom %. On the other hand, quantities of less than 6 atom % increase the wear by corrosion, oxidation or spark erosion again. The most likely reason for this is that in all cases no surface-covering aluminum oxide layer that surrounds the nickel alloy in a protective manner can be formed at the surface of the electrode material. Moreover, there will then also be insufficient aluminum to be resupplied from the interior and for the renewed production of aluminum oxide regions at the surface of the electrode. Thus, the spark-erosive wear is considerably increased in comparison with the spark plug electrode material according to the present invention.

The silicon in turn improves the corrosion and oxidation resistance at high temperatures. Chemically speaking, silicon is a non-metal and has a relatively high melting point. It therefore stabilizes the alloy, especially at high temperatures. Because of its proximity to semi-metals, however, it also exhibits physical properties that are similar to those of semiconductors. These are essential for its excellent processability in metallic alloy. This is important, especially for the electrode material according to the present invention, because it thus allows even the relatively high component of up to approximately 3 atom % of silicon to be incorporated into the alloy material in a homogenous manner. Whereas it has been very difficult until now to provide such high silicon components in nickel-base alloys, this is able to be achieved by the composition of the electrode material according to the present invention, thereby obtaining the excellent temperature resistance.

The electrode material for spark plug electrodes according to the present invention also exhibits improved thermal conductivity in comparison with conventional electrode materials. Without being bound to the theory, it is assumed that this is attributable to the extraordinary homogeneity of the composition of the electrode material. The increased thermal conductivity lowers the maximum electrode temperature, so that the corrosive attack is less pronounced.

The spark plug electrode material according to the present invention makes it possible to produce spark plugs that are able to achieve a service life that lies approximately in the same range as that for spark plugs made from noble metal materials. Whereas the service life of conventional spark plugs amounts to merely approximately 60,000 km, the service life of the spark plug electrodes according to the present invention is more than 50 percent higher, i.e., more than 90,000 km. This results in much better acceptance on the market and is advantageous both for environmental as well as economic reasons.

Spark erosion experiments were performed in order to carry out comparison testing with regard to the spark-erosive wear between a conventional electrode material and the electrode material according to the present invention. For that purpose the electrode material was mounted in a suitable holding device between a light source and a recording screen, and a shadow image was recorded in the initial state. Then, a spark was generated between the electrode surfaces multiple times. Once a predefined number of ignitions had been reached, another shadow image was finally recorded. Both shadow images were compared with one another. The spark-erosive wear was noticeable by the material removal. The quotient from the surface wear and the number of sparks therefore produced a measure for the resistance of the tested electrode material with respect to spark erosion.

In one preferred specific embodiment of the present invention, the electrode material for the spark plug electrode contains approximately 0.5 to 2 atom % of silicon and approximately 6 to 30 atom % of aluminum, in addition to the nickel-base alloy. A ratio of precisely this type has been shown to be processable in an especially satisfactory manner. Components of approximately 6 to 30 atom % of aluminum are sufficient for a homogenous aluminum distribution in the alloy material and promote the creation of finely distributed uninterrupted but thin aluminum oxide regions at the surface of the electrode material, thereby achieving the extraordinary oxidation and corrosion resistance and the minimized spark-erosive wear of the electrode. The silicon component of 0.5 to 2 atom % is especially advantageous with regard to the homogenous processability of the silicon on the one hand, and with regard to the still excellent increase in the temperature resistance of the electrode material on the other.

It is also advantageous if the aluminum component lies between approximately 7 and 10 atom %. It has been shown that in a range above 10 atom % of aluminum in the alloy, the oxidation and corrosion resistance can no longer be proportionally increased in the way it is possible with less than 15 atom %, for example. An electrode material according to the present invention, which contains aluminum in a range between approximately 7 and 10 atom %, is therefore to be preferred for economic reasons. This quantity is sufficient to provide at the surface of the nickel alloy a thin layer of aluminum oxide covering the entire surface in order to increase the oxidation and corrosion resistance as well as the spark-erosion resistance; if required, it is also sufficient to resupply aluminum from the interior of the electrode material to the surface of the electrode. Below 7 atom % to minimally 6 atom %, sufficient aluminum oxide is still able to be produced, whereas with quantities reduced even further, the wear of the electrode material begins to rise again because the aluminum oxide layer does not form across the entire surface area of the electrode.

In one additional specific embodiment, the spark plug electrode may include reactive elements in its alloy material as well, either singly or in various combinations. Referred to as reactive elements are elements from the periodic system of the elements that can be found among the ancillary group elements of the fifth and sixth period, in particular, and among the lanthanoids. These elements, referred to as reactive elements in the present invention, increase the already higher oxidation and corrosion resistance even further. It was discovered that the elements yttrium, hafnium, tantalum, cerium, lanthanum and zirconium, in particular, are especially suitable for this purpose. The reactive elements may be added to the nickel-base alloy both singly and also in any combination. The reactive elements are used in an especially preferred manner if their quantities lie within a range of less than 1 atom %. Higher quantities are not to be considered based on cost reasons alone; in addition, increased quantities of reactive elements also do not achieve any further improvement in the oxidation and corrosion resistance.

One especially satisfactory combination of reactive elements, which leads to particularly excellent resistance of the alloy material to spark erosion, oxidation and corrosion, is a combination of yttrium and hafnium. It is assumed that this is attributable to the outstanding solubility of the two elements in the nickel-base alloy. Furthermore, this combination also does not lead to the precipitation of oxides, because of the excellent solubility.

One especially preferred specific embodiment includes a spark plug electrode produced from an electrode material, which essentially is made up of nickel as base material, 0.5 to 2 atom % of silicon, and 7 to 10 atom % of aluminum. An electrode material according to these specifications includes the individual components at an extremely balanced ratio, so that the electrode material exhibits maximum oxidation and corrosion resistance as well as erosion resistance on the one hand; on the other, the thermal conductivity is optimized and the material is also able to be produced in an uncomplicated and cost-effective manner without resulting in precipitation or inhomogeneities. This ensures excellent performance of the electrode material, and thus the spark plug electrodes, in the long term.

Another especially preferred specific embodiment includes a spark plug electrode produced from an electrode material, which essentially is made up of nickel as base material, 0.5 to 2 atom % of silicon, and 7 to 10 atom % of aluminum and at least one reactive element, which is selected from the group of yttrium and/or hafnium and/or cerium and/or zirconium and/or lanthanum and/or tantalum. In comparison with a corresponding electrode material to which no reactive elements were added, such a combination exhibits an even further considerable improvement as far as the oxidation and corrosion resistance are concerned. The electrode material is therefore optimized both with regard to spark-erosive wear, thermal conductivity and additionally also with regard to the oxidation and corrosion resistance, which leads to an extremely long service life of the electrode material, and thus of the electrode produced therefrom.

The electrode material for spark plug electrodes according to the present invention may be used both for the production of the center electrode as well as for the ground electrode, and also for the production of both electrodes simultaneously.

The present invention provides spark plugs which include at least one spark plug electrode according to the present invention, and which therefore exhibit improved oxidation and corrosion resistance as well as spark-erosion resistance and thermal conductivity.

What is claimed is:

1. A spark plug electrode comprising an electrode material which comprises:

a) nickel as base material, b) 0.5 to 3 atom % of silicon, and c) at least 11 atom % of aluminum.

2. The spark plug electrode as recited in claim 1, wherein the electrode material contains a) 0.5 to 2 atom % of silicon, and b) 11 to 30 atom % of aluminum.

3. The spark plug electrode as recited in claim 2, wherein the electrode material further comprises at least one of yttrium, hafnium, cerium, zirconium, lanthanum, and tantalum as a further component.

4. The spark plug electrode as recited in claim 1, wherein the electrode material further comprises at least one of yttrium, hafnium, cerium, zirconium, lanthanum, and tantalum as a further component.

5. The spark plug electrode as recited in claim 4, wherein the electrode material contains less than 2 atom % of at least one of yttrium, hafnium, cerium, zirconium, lanthanum, and tantalum.

6. The spark plug electrode as recited in claim 4, wherein the electrode material contains less than 1 atom % of at least one of yttrium, hafnium, cerium, zirconium, lanthanum, and tantalum.

7. The spark plug electrode as recited in claim 1, wherein the spark plug electrode is a center or a ground electrode.

8. A spark plug including a spark plug electrode as recited in claim 1.

9. A spark plug electrode comprising an electrode material which comprises:

a) nickel as base material, b) 0.5 to 2 atom % of silicon, and c) at least 11 atom % of aluminum.

10. A spark plug electrode comprising an electrode material which comprises:

a) nickel as base material, b) 0.5 to 2 atom % of silicon, c) at least 11 atom % of aluminum, and d) at least one of yttrium, hafnium, cerium, zirconium, lanthanum, and tantalum.

11. The spark plug electrode as recited in claim 10, wherein less than 2 atom % of at least one of yttrium, hafnium, cerium, zirconium, lanthanum, and tantalum is present.

12. The spark plug electrode as recited in claim 10, wherein less than 1 atom % of at least one of yttrium, hafnium, cerium, zirconium, lanthanum, and tantalum is present.

13. The spark plug electrode as recited in claim 10, wherein the spark plug electrode is a center or a ground electrode.

14. A spark plug including a spark plug electrode as recited in claim 10.

15. A spark plug electrode comprising an electrode material which comprises:

a) nickel as base material, b) 0.5 to 3 atom % of silicon, and c) at least 6 atom % of aluminum, wherein the electrode material does not contain manganese.

16. The spark plug electrode as recited in claim 15, wherein the electrode material contains a) 0.5 to 2 atom % of silicon, and b) 6 to 30 atom % of aluminum.

17. A spark plug electrode comprising an electrode material which comprises:

a) nickel as base material, b) 0.5 to 2 atom % of silicon, and c) 7 to 10 atom % of aluminum, wherein the electrode material does not contain manganese.

18. A spark plug electrode comprising an electrode material which comprises:

a) nickel as base material, b) 0.5 to 2 atom % of silicon, c) 7 to 10 atom % of aluminum, and d) at least one of yttrium, hafnium, cerium, zirconium, lanthanum, and tantalum, wherein the electrode material does not contain manganese.

* * * * *

UNITED STATES PATENT AND TRADEMARK OFFICE

CERTIFICATE OF CORRECTION

PATENT NO. : 8,502,438 B2
APPLICATION NO. : 12/733029
DATED : August 6, 2013
INVENTOR(S) : Boehm et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 659 days.

Signed and Sealed this
Fifteenth Day of September, 2015

Michelle K. Lee

Michelle K. Lee
*Director of the United States Patent and Trademark Office*